US011852310B2

(12) United States Patent
Hong

(10) Patent No.: US 11,852,310 B2
(45) **Date of Patent: *Dec. 26, 2023**

(54) LIGHTING APPARATUS

(71) Applicant: XIAMEN ECO LIGHTING CO. LTD., Xiamen (CN)

(72) Inventor: Haibo Hong, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/085,719

(22) Filed: Dec. 21, 2022

(65) Prior Publication Data

US 2023/0122721 A1 Apr. 20, 2023

Related U.S. Application Data

(63) Continuation of application No. 17/468,455, filed on Sep. 7, 2021, now Pat. No. 11,585,499.

(30) Foreign Application Priority Data

Sep. 7, 2020 (CN) ..... 202021939430.7
Sep. 7, 2020 (CN) ..... 202021939506.6
(Continued)

(51) Int. Cl.
*F21S 4/28* (2016.01)
*F21V 29/70* (2015.01)
(Continued)

(52) U.S. Cl.
CPC ..... *F21S 4/28* (2016.01); *F21V 17/20* (2013.01); *F21V 23/007* (2013.01); *F21V 23/04* (2013.01); *F21V 29/70* (2015.01); *F21Y 2115/10* (2016.08)

(58) Field of Classification Search
CPC ..... F21S 4/28; F21V 17/20; F21V 23/007; F21V 23/04; F21V 29/70; F21V 3/00; F21V 17/164; F21Y 2115/10; F21Y 2103/10
See application file for complete search history.

(56) References Cited

U.S. PATENT DOCUMENTS 11,378,261 B2 * 7/2022 Lin ..... F21V 19/0015
2011/0194296 A1 * 8/2011 Chou ..... F21K 9/272 362/362
(Continued)

FOREIGN PATENT DOCUMENTS

CN 206101217 U * 4/2017
CN 208222266 U * 12/2018
(Continued)

*Primary Examiner* — Jong-Suk (James) Lee
*Assistant Examiner* — Glenn D. Zimmerman
(74) *Attorney, Agent, or Firm* — Chun-Ming Shih; LANWAY IPR SERVICES

(57) ABSTRACT

A lighting apparatus includes a light passing cover, a light strip, a heat dissipation plate, a manual switch, a driver and a bottom cover. The light passing cover defines first elongated cavity. The light strip is mounted with multiple LED modules. The heat dissipation plate is used for mounting the light strip on a first side of the heat dissipation plate. The manual switch is disposed for selecting a switch setting. The manual switch is placed on the first side of the heat dissipation plate. The driver converts an external power source to a driving current supplied to the multiple LED modules. The driver is electrically connected to the manual switch for controlling the driving current supplied to the multiple LED modules to adjust an output light of the multiple LED modules according to the selected switch setting. The bottom cover defines a second elongated cavity.

18 Claims, 11 Drawing Sheets

(30) Foreign Application Priority Data

Sep. 7, 2020 (CN) ..... 202021939642.5
Sep. 7, 2020 (CN) ..... 202021948472.7

(51) Int. Cl.

| | |
|---|---|
| ***F21V 23/00*** | (2015.01) |
| ***F21V 17/20*** | (2006.01) |
| ***F21V 23/04*** | (2006.01) |
| *F21Y 115/10* | (2016.01) |

(56) References Cited

U.S. PATENT DOCUMENTS

| | | | | |
|---|---|---|---|---|
| 2012/0106144 | A1* | 5/2012 | Chang | F21K 9/27 362/218 |
| 2014/0268748 | A1* | 9/2014 | Lay | F21V 23/009 362/362 |
| 2019/0277460 | A1* | 9/2019 | Van Winkle | F21V 23/06 |
| 2020/0278106 | A1* | 9/2020 | Chen | F21V 23/003 |
| 2021/0156552 | A1* | 5/2021 | Xie | F21V 23/009 |
| 2021/0372578 | A1* | 12/2021 | Lin | F21V 17/164 |

FOREIGN PATENT DOCUMENTS

| | | | | |
|---|---|---|---|---|
| CN | 211372121 | U | * | 8/2020 |
| JP | 2011143248 | A | * | 7/2011 |
| WO | WO-2017190986 | A1 | * | 11/2017 |

* cited by examiner

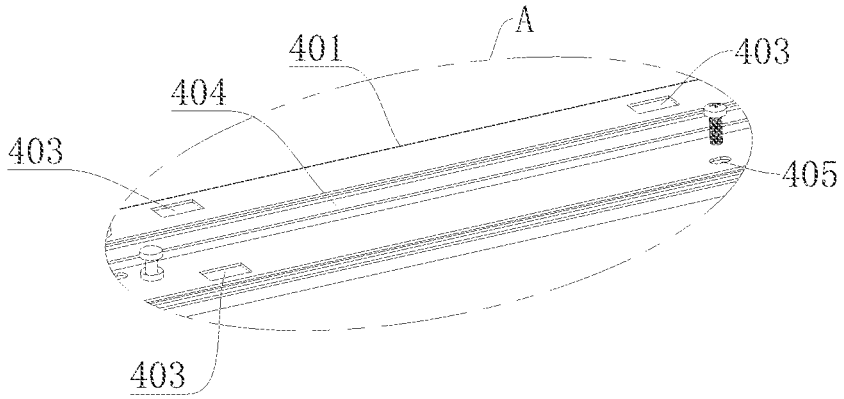
Fig. 2
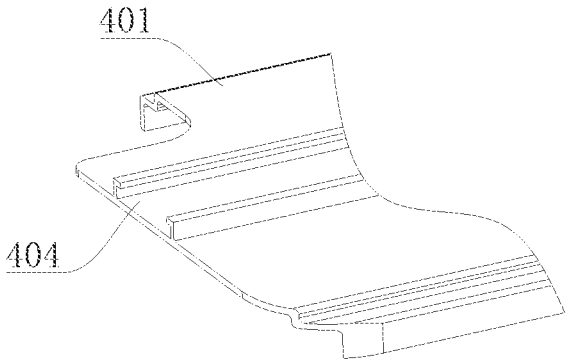
Flg. 3
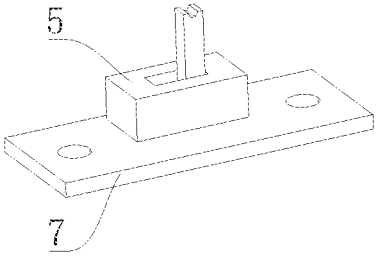
Fig. 4

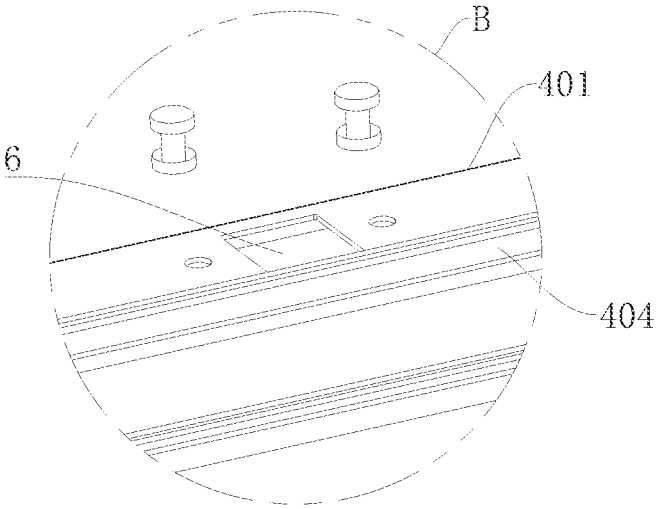
Flg. 5
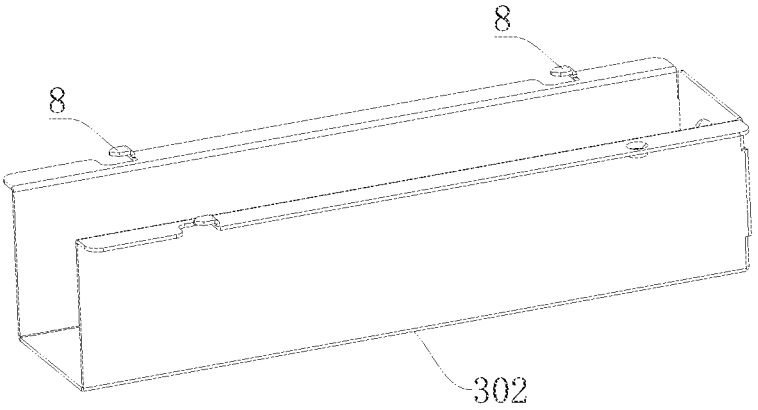
Fig. 6

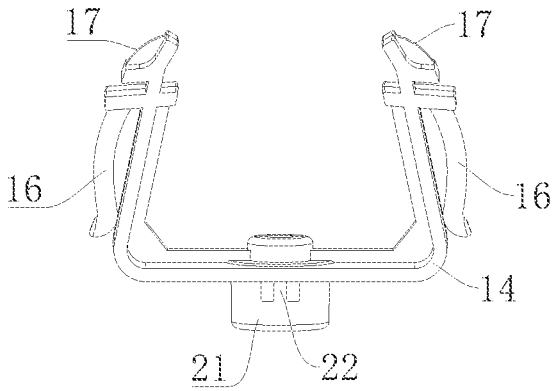
Flg. 12
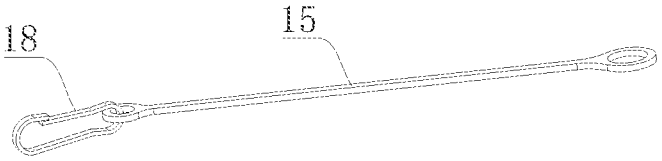
Fig. 13
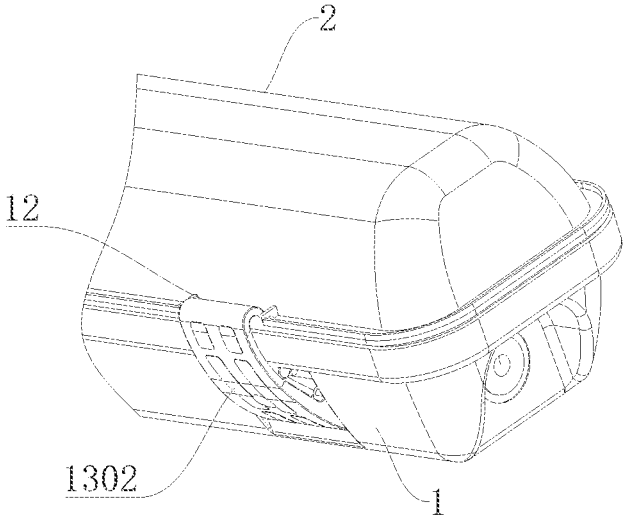
Fig. 14

LIGHTING APPARATUS

RELATED FIELD

The present application is a continued application of U.S. patent Ser. No. 17/468,455.

FIELD

The present invention is related to a lighting apparatus, and more particularly related to a lighting apparatus with a compact assembly structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

There are various light devices used and designed for various environments. For example, some light devices are designed with an elongated shape for emitting light as an elongated panel.

It is important to design an assembly structure for such elongated light devices. For example, screws usually make the assembling more difficult.

In addition, it is important and useful if the light device may be adjusted for adding flexibility. The adjustment may not be too often. For example, when a user installs the light device, the user may assembly the light device. During the assembling, if a configuration is provided, the user may adjust the setting and then hide the setting with the housing of the light device.

Therefore, it is beneficial to consider multiple factors to design a useful and robust light device satisfying different needs. There are various light devices used and designed for various environments. For example, some light devices are designed with an elongated shape for emitting light as an elongated panel.

It is important to design an assembly structure for such elongated light devices. For example, screws usually make the assembling more difficult.

In addition, it is important and useful if the light device may be adjusted for adding flexibility. The adjustment may not be too often. For example, when a user installs the light device, the user may assembly the light device. During the assembling, if a configuration is provided, the user may adjust the setting and then hide the setting with the housing of the light device.

Therefore, it is beneficial to consider multiple factors to design a useful and robust light device satisfying different needs. There are various light devices used and designed for various environments. For example, some light devices are designed with an elongated shape for emitting light as an elongated panel.

It is important to design an assembly structure for such elongated light devices. For example, screws usually make the assembling more difficult.

In addition, it is important and useful if the light device may be adjusted for adding flexibility. The adjustment may not be too often. For example, when a user installs the light device, the user may assembly the light device. During the assembling, if a configuration is provided, the user may adjust the setting and then hide the setting with the housing of the light device.

Therefore, it is beneficial to consider multiple factors to design a useful and robust light device satisfying different needs. There are various light devices used and designed for various environments. For example, some light devices are designed with an elongated shape for emitting light as an elongated panel.

It is important to design an assembly structure for such elongated light devices. For example, screws usually make the assembling more difficult.

In addition, it is important and useful if the light device may be adjusted for adding flexibility. The adjustment may not be too often. For example, when a user installs the light device, the user may assembly the light device. During the assembling, if a configuration is provided, the user may adjust the setting and then hide the setting with the housing of the light device.

Therefore, it is beneficial to consider multiple factors to design a useful and robust light device satisfying different needs.

SUMMARY

In some embodiments, a lighting apparatus includes a light passing cover, a light strip, a heat dissipation plate, a manual switch, a driver and a bottom cover.

The light passing cover defines first elongated cavity.

The light strip is mounted with multiple LED modules.

The heat dissipation plate is used for mounting the light strip on a first side of the heat dissipation plate.

The manual switch is disposed for selecting a switch setting.

The manual switch is placed on the first side of the heat dissipation plate.

The driver converts an external power source to a driving current supplied to the multiple LED modules.

The driver is electrically connected to the manual switch for controlling the driving current supplied to the multiple LED modules to adjust an output light of the multiple LED modules according to the selected switch setting.

The bottom cover defines a second elongated cavity.

The deriver is placed in the second elongated cavity.

A first edge of the light passing cover is connected to a second edge of the bottom cover to conceal the first elongated cavity and the second elongated cavity to conceal the driver and the light strip.

In some embodiments, the manual switch is a sliding switch for selecting an option from multiple candidate positions.

The manual switch is placed in the first elongated cavity.

In some embodiments, the sliding switch is placed on a top of the driver box.

The heat dissipation plate has a switch opening for the sliding switch to pass through from the second elongated cavity to the first elongated cavity.

In some embodiments, the heat dissipation plate has a groove for placing the light strip.

In some embodiments, the heat dissipation plate has a track for inserting the light strip along the track to fix to the heat dissipation plate.

In some embodiments, the bottom cover has multiple plate buckles for buckling the heat dissipation plate to the bottom cover.

In some embodiments, the plate buckle has a pair of elastic curve clips.

In some embodiments, the driver is placed at a middle of the second elongated cavity.

In some embodiments, the driver has a driver circuit and a driver box.

The driver circuit is enclosed by the driver box.

In some embodiments, a wiring box has a top opening.

An external wire is inserted into the wiring box to be electrically connected to the driver circuit.

Top opening of the wiring box exposes a connector of the driver for electrically connecting the external wire and the driver circuit.

In some embodiments, the wiring box is placed adjacent to the driver box.

In some embodiments, a tube is placed adjacent to the wiring box for guiding the external wire from outside into the wiring box.

In some embodiments, a water proof connector is attached on one end of the bottom cover for inserting the external wire into the tube.

In some embodiments, the lighting apparatus may also include multiple buckles.

Each buckle has a first end attaching to the bottom cover and a second end attached to light passing cover.

In some embodiments, the first edge of the light passing cover has multiple buckle groove for inserting the second ends of the buckles.

In some embodiments, the bottom cover has multiple buckle locks for locking the first ends of the multiple buckles.

In some embodiments, a safety string has a first end and a second end.

The first end of the safety string is fixed to the bottom cover.

The second end of the safety string is fixed to the heat dissipation plate.

In some embodiments, the heat dissipation plate has a string hole.

The string hole has a string entrance and a string track.

The second end of the safety string has an enlarged head for passing through the string entrance while keeping in the string track.

In some embodiments, the manual switch is a rotation switch for selecting the switch setting from a continuous range.

In some embodiments, the switch setting corresponds to a maximum light intensity of the light strip.

BRIEF DESCRIPTION OF DRAWINGS

FIG. 2 illustrates a component of the example in FIG. 1.

FIG. 3 illustrates another component of the example in FIG. 1.

FIG. 4 illustrates a manual switch example.

FIG. 5 illustrates a component example.

FIG. 6 illustrates a wiring box example.

FIG. 12 illustrates another view of the buckle example.

FIG. 13 illustrates a safety string example.

FIG. 14 illustrates a buckling example.

DETAILED DESCRIPTION

Figure 22:
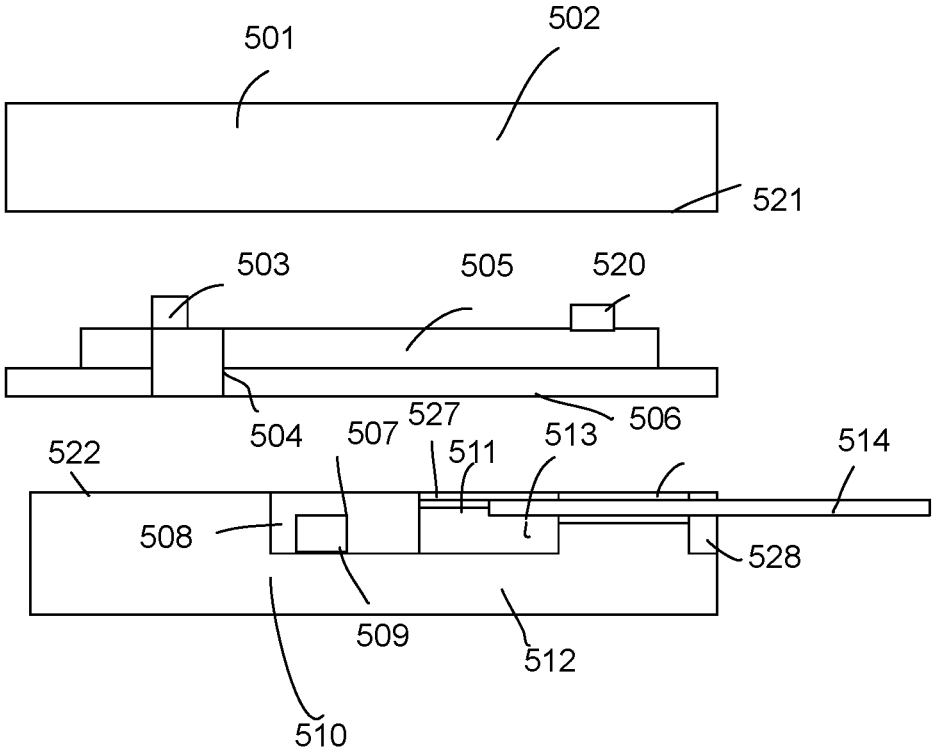
FIG. 22 shows another embodiment of a lighting apparatus.

Please refer to FIG. 22, which shows a lighting apparatus example.

In FIG. 22, a lighting apparatus includes a light passing cover 502, a light strip 505, a heat dissipation plate 506, a manual switch 503, a driver 508 and a bottom cover 510.

The light passing cover 502 defines first elongated cavity 501.

The light strip 505 is mounted with multiple LED modules 520.

The heat dissipation plate 506 is used for mounting the light strip 505 on a first side of the heat dissipation plate 506.

The manual switch 503 is disposed for selecting a switch setting.

The manual switch 503 is placed on the first side of the heat dissipation plate 506. In such design, the manual switch 503 and the light strip 505 are placed on the same side of the heat dissipation plate 506. The heat dissipation plate may be made of a metal plate or other heat conductive material, with or without an insulation layer.

The driver 508 converts an external power source to a driving current supplied to the multiple LED modules 520.

The driver 508 is electrically connected to the manual switch 503 for controlling the driving current supplied to the multiple LED modules 520 to adjust an output light of the multiple LED modules 520 according to the selected switch setting. For example, the selected switch setting may be corresponding to a required color temperature, a required color, a required light intensity or any of combination thereof.

The bottom cover 510 defines a second elongated cavity 512.

The driver 508 is placed in the second elongated cavity 512.

A first edge 521 of the light passing cover 502 is connected to a second edge 522 of the bottom cover 512 to conceal the first elongated cavity 501 and the second elongated cavity 512 to conceal the driver 508 and the light strip 505.

In some embodiments, the manual switch 503 is a sliding switch for selecting an option from multiple candidate positions. For example, three color temperatures are provided to be selected.

The manual switch 503 is placed in the first elongated cavity. In some embodiments, the manual switch is a sliding switch. The driver 508 has a driver box 507 and a driver circuit 509.

In some embodiments, the sliding switch is placed on a top of the driver box 507.

The heat dissipation plate 506 has a switch opening 504 for the sliding switch to pass through from the second elongated cavity 510 to the first elongated cavity 501.

In some embodiments, the heat dissipation plate 506 has a groove for placing the light strip. For example, the groove has a similar but a little larger size than the light strip so that the light strip 505 is size fitting to the groove.

In some embodiments, the heat dissipation plate 506 has a track for inserting the light strip along the track to fix to the heat dissipation plate 506.

In some embodiments, the bottom cover has multiple plate buckles for buckling the heat dissipation plate to the bottom cover.

Figure 1:
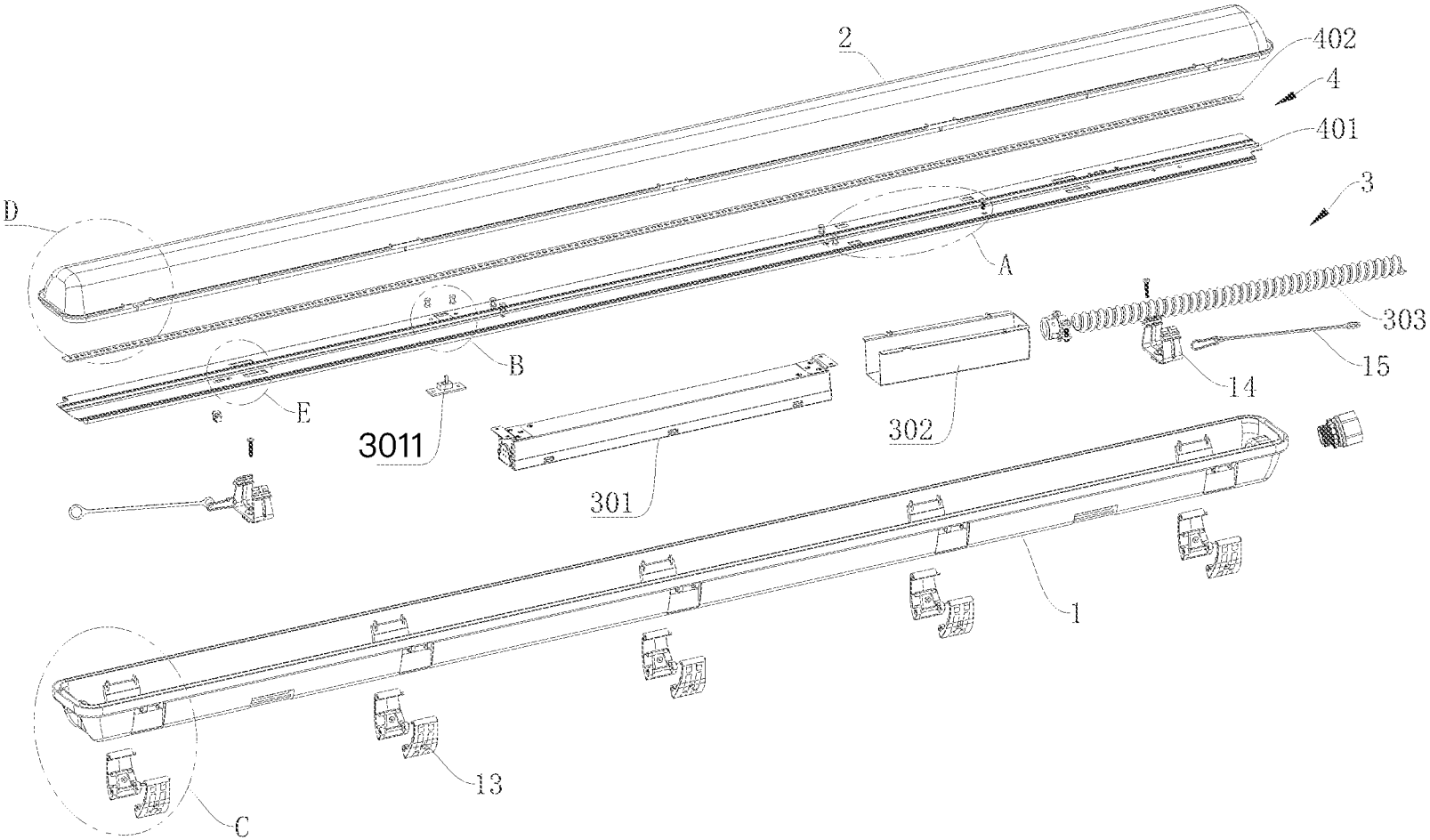
FIG. 1 illustrates an exploded view of a lighting apparatus embodiment.

For example, FIG. 1 shows the buckles 13 in an exploded view example.

In some embodiments, the plate buckle has a pair of elastic curve clips.

Figure 19:
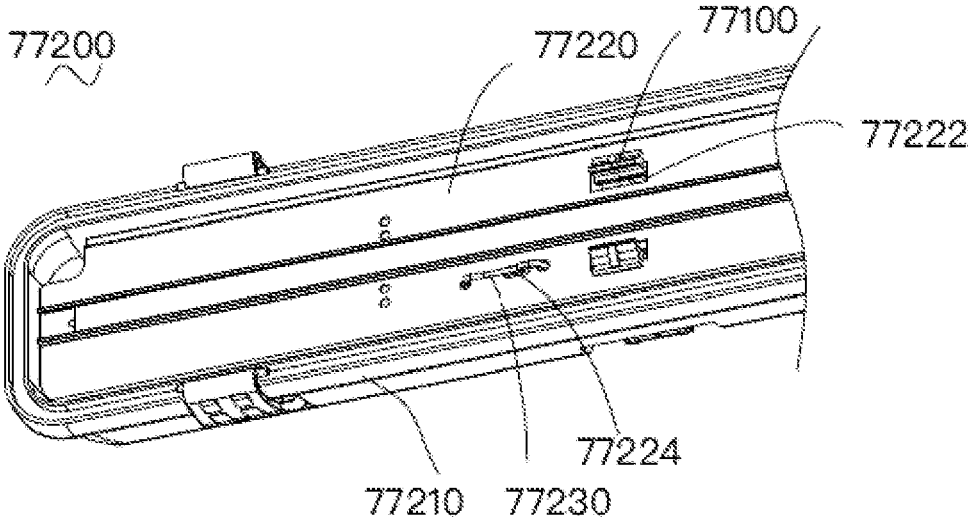
FIG. 19 illustrates a zoom-up view of a portion of an example.

FIG. 19 shows an example of the pair of elastic curve clips 77100.

In some embodiments, the driver is placed at a middle of the second elongated cavity, as shown in FIG. 1 and FIG. 22.

Please be noted that the term "middle" used in this sentence does not mean an absolute middle position of the second elongated cavity.

In FIG. 22, the driver 508 has a driver circuit 507 and a driver box 509.

The driver circuit 507 is enclosed by the driver box 509.

In some embodiments, a wiring box 513 has a top opening 527.

An external wire 514 is inserted into the wiring box 513 to be electrically connected to the driver circuit 507.

The top opening 527 of the wiring box 513 exposes a connector 511 of the driver 508 for electrically connecting the external wire 514 and the driver circuit 507.

In some embodiments, the wiring box 513 is placed adjacent to the driver box 509.

In some embodiments, a tube 506 is placed adjacent to the wiring box 513 for guiding the external wire 514 from outside into the wiring box 513.

In some embodiments, a water proof connector 528 is attached on one end of the bottom cover 512 for inserting the external wire 514 into the tube 506.

In some embodiments, the lighting apparatus may also include multiple buckles.

Each buckle has a first end attaching to the bottom cover and a second end attached to light passing cover, as shown in the example of FIG. 1.

In FIG. 14, the first edge of the light passing cover has multiple buckle groove for inserting the second ends of the buckles.

In FIG. 14, the bottom cover has multiple buckle locks for locking the first ends of the multiple buckles.

In FIG. 13, a safety string 15 has a first end and a second end.

Figure 18:
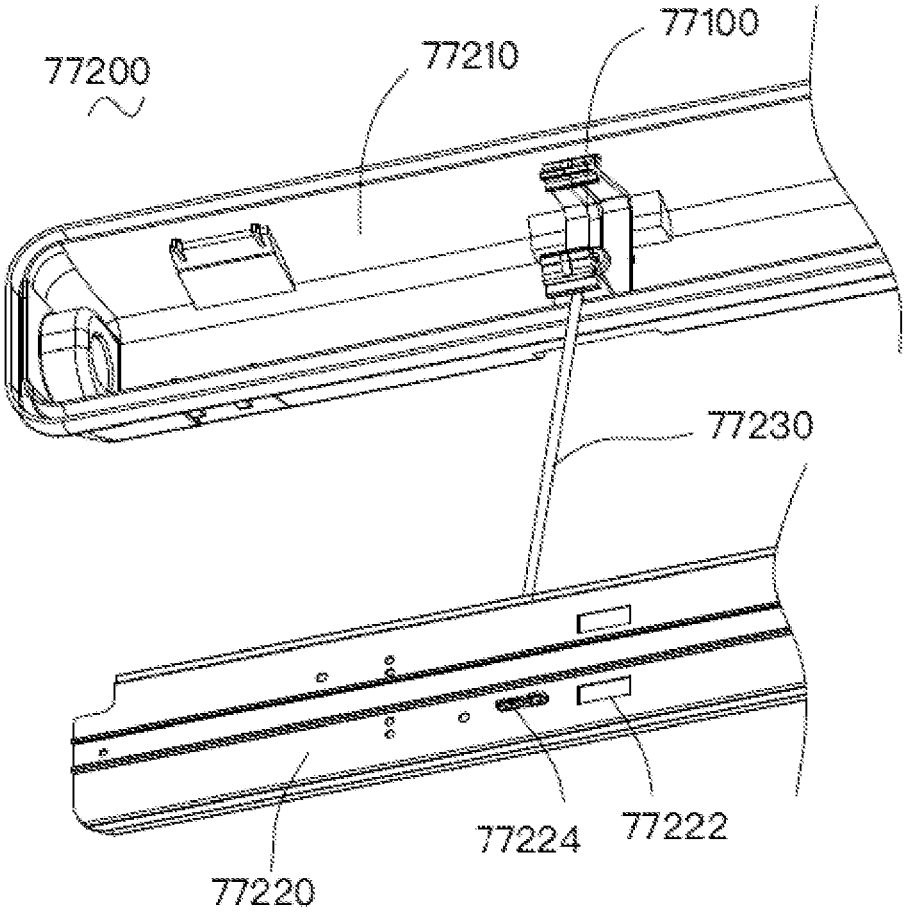
FIG. 18 illustrates usage example of the safety string.

In FIG. 18, the first end of the safety string 77230 is fixed to the bottom cover 77210.

The second end of the safety string 77230 is fixed to the heat dissipation plate.

In FIG. 18, the heat dissipation plate has a string hole 77224.

The string hole 77224 has a string entrance and a string track.

The second end of the safety string has an enlarged head for passing through the string entrance while keeping in the string track.

In FIG. 22, the manual switch 503 is a rotation switch for selecting the switch setting from a continuous range.

In some embodiments, the switch setting corresponds to a maximum light intensity of the light strip.

Please refer to FIG. 1, which shows an exploded of a lighting apparatus example.

In FIG. 1, the lighting apparatus has a light passing cover 2, a light source 4 with a light strip 402 and a heat dissipation plate 401, a driver 3 has a driver box 301, a manual switch 3011, a wiring box 302, a tube 303, a bottom cover 1, multiple buckles 13, a safety strip 15, a plate buckle 14.

The same reference numerals refer to the same components among following drawings and associated description.

In FIG. 2, the heat dissipation plate 401 has an insertion track 404 for inserting the light strip. There is a first buckle opening 403 on the heat dissipation plate 401 for buckling other components.

In FIG. 3, the heat dissipation plate 401 has an insertion track 404.

In FIG. 4, the manual switch has a sliding plug 5 and a circuit board 7.

In FIG. 5, the heat dissipation plate 401 has an insertion track 404 and an switch opening 6 for inserting the manual switch.

In FIG. 6, the wiring box 302 has hooks 8 and a top opening for exposing the inserted external wire.

Figure 7:
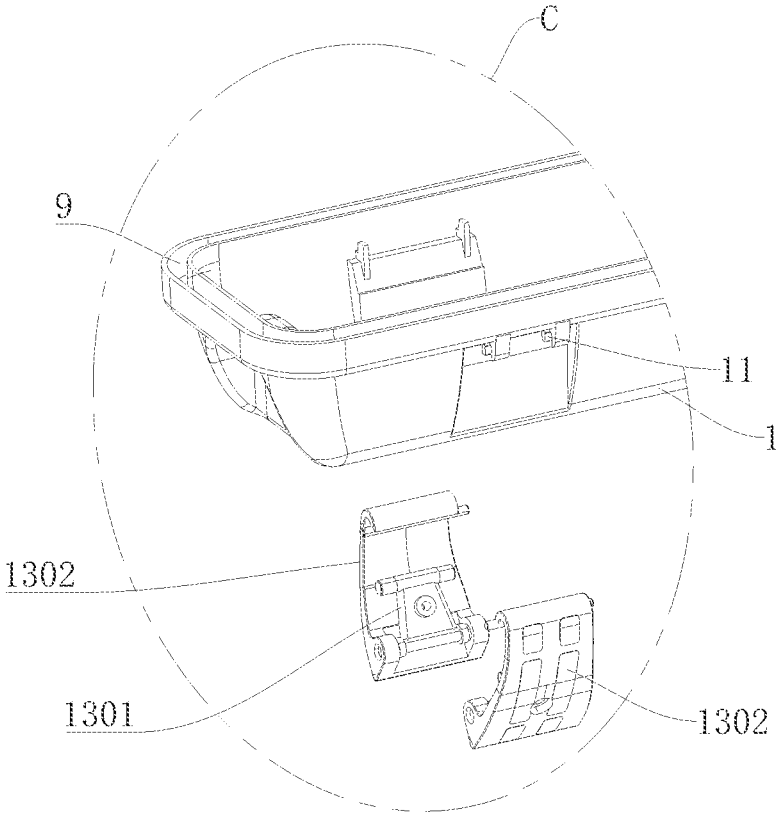
FIG. 7 illustrates a buckle example.

In FIG. 7, the buckle has a first end 1301 and a second end 1302. The second end 1302 is fixed to a buckle lock 11 of the bottom cover 1. There is a positioning groove 9 for aligning the light passing cover during assembling.

Figure 8:
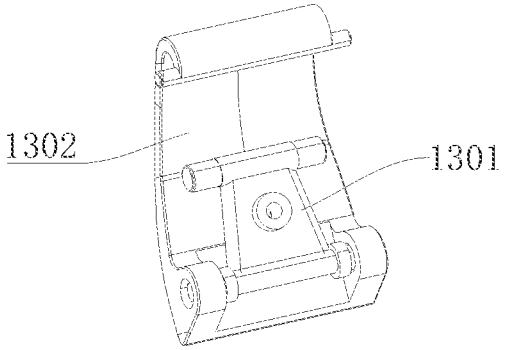
FIG. 8 illustrates a buckle example zoom-up view.

FIG. 8 shows a zoom-up view of the buckle component.

Figure 9:
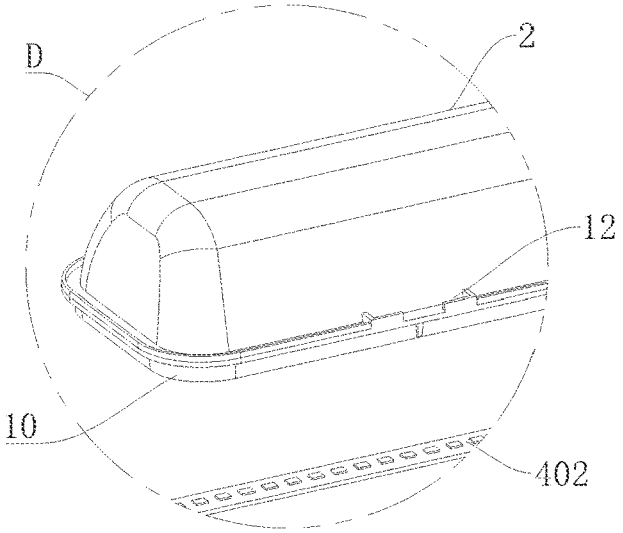
FIG. 9 illustrates a zoom-up view of a part in the example of FIG. 1.

FIG. 9 shows a buckle groove disposed on the light passing cover 2. There is a positioning protrusion 10 corresponding to the positioning groove 9 in FIG. 7.

Figure 10:
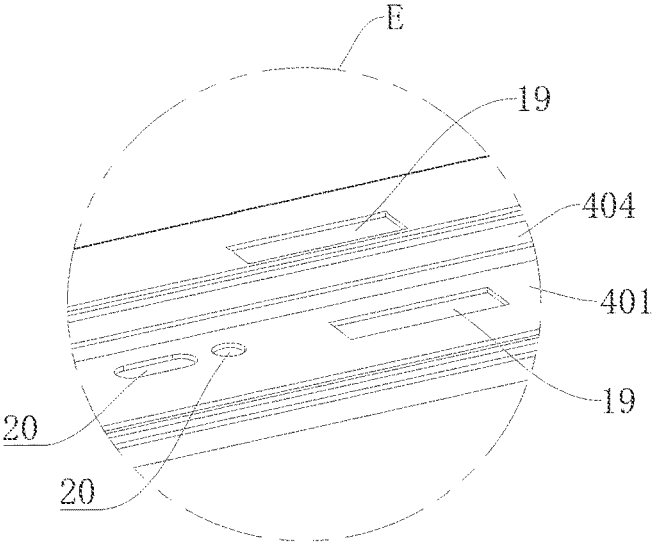
FIG. 10 illustrates a connection example.

FIG. 10 shows the heat dissipation plate 401 has an insertion track and two buckle openings 19. There is a string opening 20 on the heat dissipation plate 401 for attaching a safety string to prevent components detached during assembly.

Figure 11:
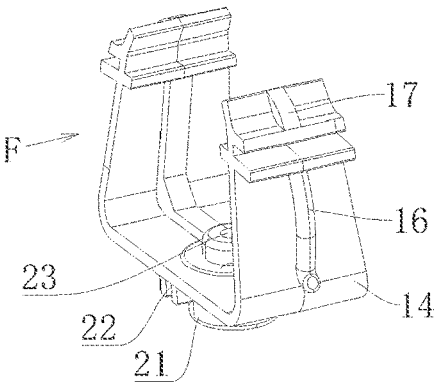
FIG. 11 illustrates a buckle example.

FIG. 11 shows a plate buckle example. In FIG. 11, the plate buckle has a guiding surface 17, a hook part 16, an inner buckle 14, an installation hole 23, a limiting roove 22 and a installation platform 21.

FIG. 12 shows another view of the example in FIG. 11.

FIG. 13 shows a safety string 15 with a hook 18.

FIG. 14 shows a buckle 1302 buckling the bottom cover 1 to the buckle groove 12 of the light passing cover 2.

Figure 15:
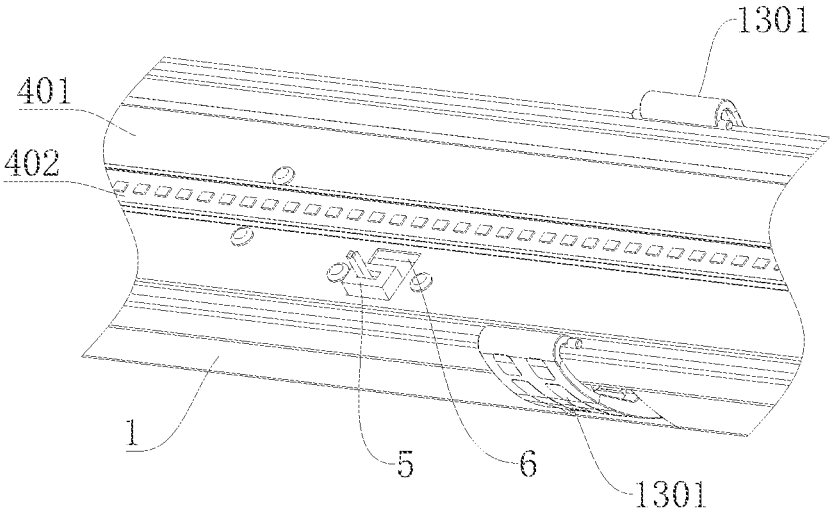
FIG. 15 illustrates a zoom-up view showing the manual switch.

FIG. 15 shows a first buckle end 1301, the switch opening 6 and the manual switch 5 disposed on the bottom cover 1 and the heat dissipation plate 401. There is a light strip 402 disposed on the heat dissipation plate 401.

Figure 16:
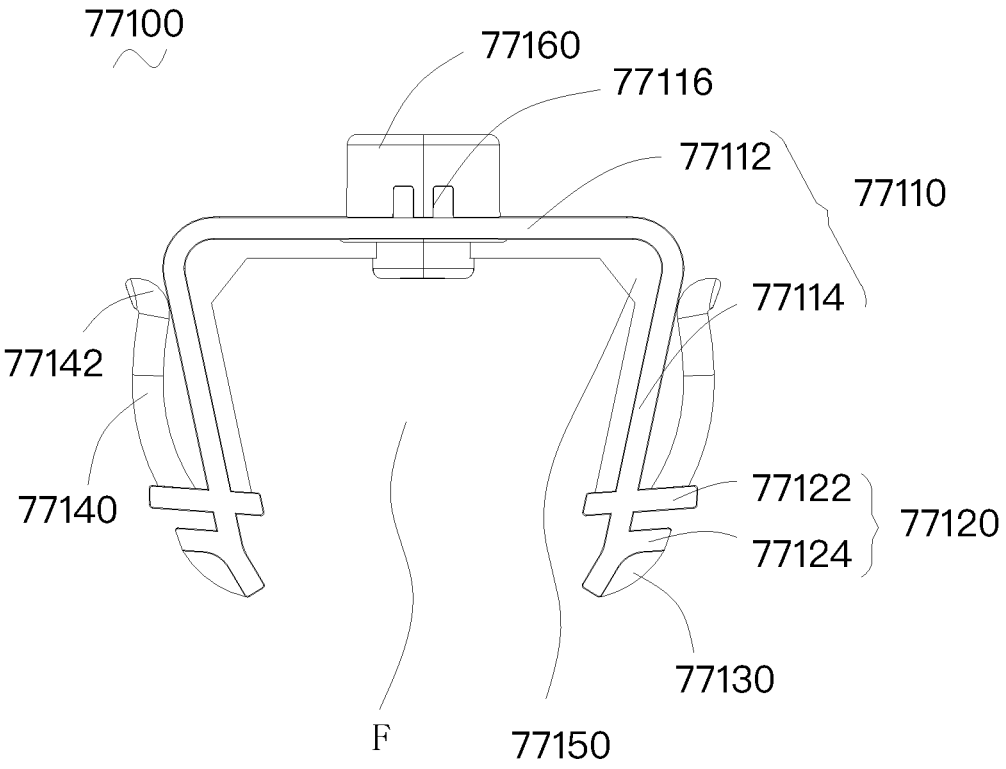
FIG. 16 illustrates another view of the buckle example.
Figure 17:
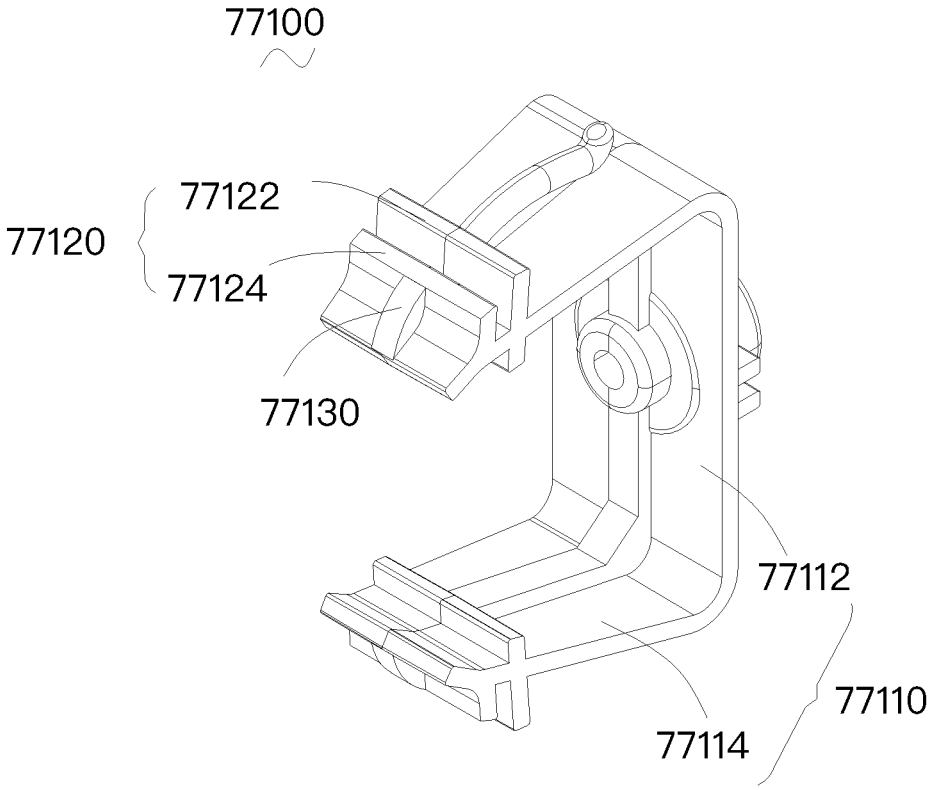
FIG. 17 illustrates another view of the buckle example.

FIG. 16 and FIG. 17 show a plate buckle example.

In FIG. 16, and FIG. 17, the plate buckle 77100 has a limiting groove 77116, a second locking sleeve 77160, a buckle body 77110, a buckle arm 77114, a buckle part with a first buckle clip 77122 and a second buckle clip 77124, an arch shape rib plate 77130, an enhanced rib 77150, a curved edge 77142 and an arc shape hook 77140.

FIG. 18 shows a connection of components using the safety string 77230 forming an assembly structure 77200. Two ends of the safety string 77230 are attached to the bottom cover 77210 and the heat dissipation plate 77220. There is a string hole 77224 and a holding hole 77222 disposed on the heat dissipation plate 77220.

FIG. 19 shows another view of the example in FIG. 18.

Figure 20:
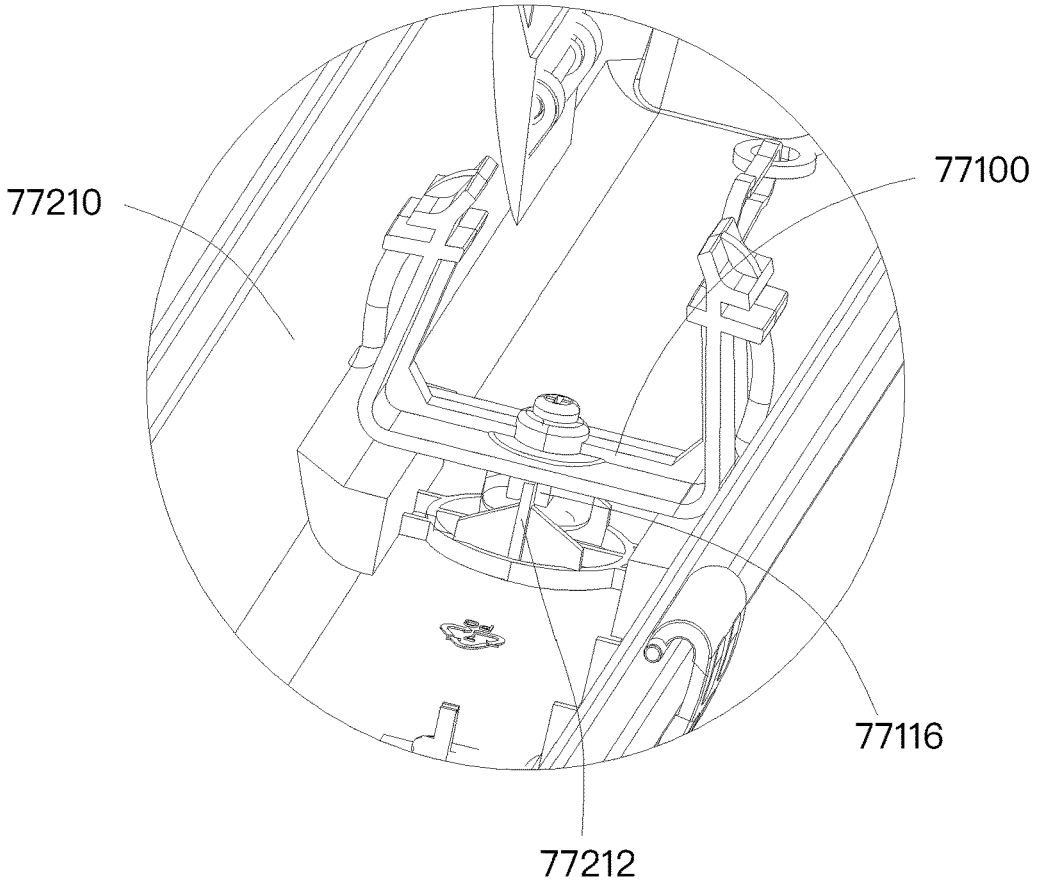
FIG. 20 illustrates a zoom-up view of a portion of an example.

FIG. 20 shows a bottom cover 77210 with a plate buckle. The plate buckle has a fixing clip 77100, a limiting groove 77116 and a limiting rib 77212.

Figure 21:
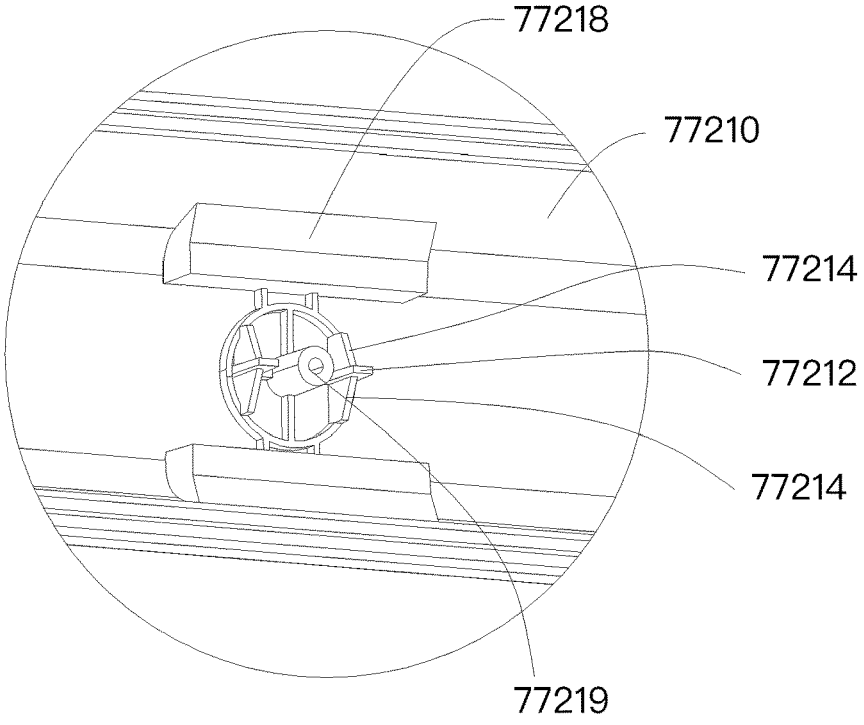
FIG. 21 illustrates a zoom-up view of an portion of an example.

FIG. 21 shows a zoom-up view of the plate buckle. In FIG. 21, the plate buckle is fixed to the bottom cover 77210. There is a support rib plate 77214, a limiting bar 77212, a locking sleeve 77219.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light passing cover for defining a first elongated cavity;

a light strip mounted with multiple LED modules;

a heat dissipation plate for mounting the light strip on a first side of the heat dissipation plate;

a manual switch for selecting a switch setting, wherein the manual switch is placed on the first side of the heat dissipation plate;

a driver for converting an external power source to a driving current supplied to the multiple LED modules, wherein the driver is electrically connected to the manual switch for controlling the driving current supplied to the multiple LED modules to adjust an output light of the multiple LED modules according to the selected switch setting; and a bottom cover for defining a second elongated cavity, wherein the driver is placed in the second elongated cavity, wherein a first edge of the light passing cover is connected to a second edge of the bottom cover to conceal the first elongated cavity and the second elongated cavity to conceal the driver and the light strip, wherein the bottom cover has multiple plate buckles for buckling the heat dissipation plate to the bottom cover, wherein each plate buckle has a pair of elastic curve clips.

2. The lighting apparatus of claim 1, wherein the manual switch is a sliding switch for selecting an option from multiple candidate positions, wherein the manual switch is placed in the first elongated cavity.

3. The lighting apparatus of claim 2, wherein the sliding switch is placed on a top of the driver box, wherein the heat dissipation plate has a switch opening for the sliding switch to pass through from the second elongated cavity to the first elongated cavity.

4. The lighting apparatus of claim 2, wherein the heat dissipation plate has a groove for placing the light strip.

5. The lighting apparatus of claim 2, wherein the heat dissipation plate has a track for inserting the light strip along the track to fix to the heat dissipation plate.

6. The lighting apparatus of claim 2, wherein the driver is placed at a middle of the second elongated cavity.

7. The lighting apparatus of claim 6, wherein the driver has a driver circuit and a driver box, wherein the driver circuit is enclosed by the driver box.

8. The lighting apparatus of claim 7, wherein a wiring box has a top opening, wherein an external wire is inserted into the wiring box to be electrically connected to the driver circuit, wherein top opening of the wiring box exposes a connector of the driver for electrically connecting the external wire and the driver circuit.

9. The lighting apparatus of claim 8, wherein the wiring box is placed adjacent to the driver box.

10. The lighting apparatus of claim 9, wherein a tube is placed adjacent to the wiring box for guiding the external wire from outside into the wiring box.

11. The lighting apparatus of claim 10, wherein a water proof connector is attached on one end of the bottom cover for inserting the external wire into the tube.

12. The lighting apparatus of claim 2, further comprising multiple buckles, wherein each buckle has a first end attaching to the bottom cover and a second end attached to light passing cover.

13. The lighting apparatus of claim 12, wherein the first edge of the light passing cover has multiple buckle groove for inserting the second ends of the buckles.

14. The lighting apparatus of claim 13, wherein the bottom cover has multiple buckle locks for locking the first ends of the multiple buckles.

15. The lighting apparatus of claim 2, wherein a safety string has a first end and a second end, wherein the first end of the safety string is fixed to the bottom cover, wherein the second end of the safety string is fixed to the heat dissipation plate.

16. The lighting apparatus of claim 15, wherein the heat dissipation plate has a string hole, wherein the string hole has a string entrance and a string track, wherein the second end of the safety string has an enlarged head for passing through the string entrance while keeping in the string track.

17. The lighting apparatus of claim 1, wherein the manual switch is a rotation switch for selecting the switch setting from a continuous range.

18. The lighting apparatus of claim 17, wherein the switch setting corresponds to a maximum light intensity of the light strip.

* * * * *